US005690085A

United States Patent [19]

Kawamoto

[11] Patent Number: 5,690,085

[45] Date of Patent: Nov. 25, 1997

[54] CONTROL CIRCUIT FOR IGNITION COIL

[75] Inventor: Atsunobu Kawamoto, Tokyo, Japan

[73] Assignee: Mitsubishi Denki Kabushiki Kaisha, Tokyo, Japan

[21] Appl. No.: 738,282

[22] Filed: Oct. 25, 1996

[30] Foreign Application Priority Data

Apr. 26, 1996 [JP] Japan ..... 8-107163

[51] Int. Cl.[6] ..... F02P 3/05

[52] U.S. Cl. ..... 123/644; 315/209 T; 315/224

[58] Field of Search ..... 123/644; 315/209 T, 315/224; 361/263

[56] References Cited

U.S. PATENT DOCUMENTS 4,899,715 2/1990 Koiwa et al. ..... 123/644

5,199,407 4/1993 Sawawzaki et al. ..... 123/644

*Primary Examiner*—Andrew M. Dolinar

[57] ABSTRACT

An ignition coil control circuit for controlling a current flowing to a primary coil of an ignition coil, comprises a switching circuit for switching the primary coil of the ignition coil, a driving circuit for driving the switching circuit, a control signal output circuit for generating and outputting a driving control signal to the driving circuit in accordance with a signal from an ECU, and a current limiting circuit for detecting a value of the current fed to the primary coil by the switching circuit and controlling the switching circuit to make the current value not larger than a predetermined value and wherein the control signal output circuit uses the signal from the ECU as its power source, and the current limiting circuit uses a switching driving signal output from the driving circuit for driving the switching circuit as its power source.

7 Claims, 4 Drawing Sheets

CONTROL CIRCUIT FOR IGNITION COIL

BACKGROUND OF THE INVENTION

1. Field of the Invention

The present invention relates to a control circuit for an automobile ignition coil.

2. Description of the Prior Art

Conventionally, in a control circuit for controlling an ignition coil with primary and secondary coils to impress a high voltage to an ignition plug used in an automobile engine or the like, the current of a primary coil in the ignition coil has been set not to exceed a regulated value so as to protect a power element or the like which consists of, for example, power transistors connected in the Darlington connection for switching of the current of the primary coil.

FIG. 7 is a schematic block diagram of a conventional model of the ignition coil control circuit referred to above. In FIG. 7, a battery 80 is connected to a primary coil 81*a* and a secondary coil 81*b* of an ignition coil 81. The other end of the primary coil 81*a* is connected to a collector of a Darlington power transistor 82 consisting of two NPN power transistors in the Darlington connection. An emitter of the Darlington power transistor 82 is grounded via a current detection resistor 83 for detecting a current running in the Darlington power transistor 82. Meanwhile, the other end of the secondary coil 81*b* of the ignition coil 81 is earthed via an ignition plug 84.

A base of the Darlington power transistor 82 is connected to a current limiting circuit 85 and a collector of an NPN transistor 86, and connected also to the battery 80 via a source resistor 87. A power is supplied to the current limiting circuit 85 from the battery 80 via the source resistor 87. The current limiting circuit 85 is also connected to a connecting line between the emitter of the Darlington power transistor 82 and the current detection resistor 83. A base of the NPN transistor 86 is connected to an ECU 88 to which a power is supplied from the battery 80.

A connecting line of the base of the Darlington power transistor 82, current limiting circuit 85, collector of the NPN transistor 86 and source resistor 87 are earthed via a capacitor 89. An ignition coil control circuit 90 is constituted of the Darlington power transistor 82, current detection resistor 83, current limiting circuit 85 and capacitor 89. The ignition coil control circuit 90 is a hybrid integrated circuit. The base of the Darlington power transistor 82 is a base of the NPN power transistor of the first stage, and the emitter of the Darlington power transistor 82 is an emitter of the NPN power transistor of the last stage. The collector of the Darlington power transistor 82 is a connecting part where collectors of the NPN power transistors are connected each other.

In the above-described constitution of the conventional ignition coil control circuit 90, when the ECU 88 turns off the NPN transistor 86, a current is supplied to the base of the Darlington power transistor 82 from the battery 80 via the source resistor 87, so that the Darlington power transistor 82 is turned on to feed the base current to the primary coil 81*a* of the ignition coil 81. The current detection resistor 83 is used to detect the current flowing in the primary coil 81*a* of the ignition coil 81 when the Darlington power transistor 82 is in the ON state. When the current detection resistor 83 detects the current flowing in the primary coil 81*a* of the ignition coil 81 to be not smaller than a predetermined regulated value, that is, a voltage decrease in the current detection resistor 83 is not smaller than a predetermined regulated value, the current limiting circuit 85 controls the base current of the Darlington power transistor 82 to prevent the current of not smaller than the regulated value from flowing in the primary coil 81*a*.

However, because of the fact that the current limiting circuit 85 receives power from the battery 80 via the source resistor 87, the circuit 85 has been subjected to a voltage change in the battery 80 and unable to operate stably. The capacitor 89 for the stabilization of the power source has thus been indispensable to drive the circuit 85 stably. At the same time, the current detection resistor 83 required to be accurate in resistance values is a high-cost resistor. In other words, the capacitor 89 and the current detection resistor 83 have been the cause of the cost rise of the ignition coil control circuit.

SUMMARY OF THE INVENTION

An object of the present invention is therefore to provide an ignition coil control circuit which can prevent a current of not smaller than a predetermined regulated value from running to a primary coil of the ignition coil without being influenced by a voltage change in a battery, with costs reduced.

In order to achieve the aforementioned objective, according to the present invention, there is provided an ignition coil control circuit for controlling in accordance with a signal from an ECU a current flowing to a primary coil of an ignition coil to impress a high voltage to an ignition plug, comprising a switching circuit for switching the primary coil of the ignition coil, a driving circuit for driving/switching the switching circuit, a control signal output circuit for generating and outputting a driving control signal to the driving circuit in accordance with the signal from the ECU, and a current limiting circuit for detecting a value of the current applied to the primary coil by the switching circuit and controlling the switching circuit so as to make the current not larger than a predetermined value, wherein the control signal output circuit uses the signal from the ECU as its power source, and the current limiting circuit uses a switching driving signal output from the driving circuit for driving/switching the switching circuit as its power source.

More concretely, the switching circuit is formed of an NPN transistor and, the current limiting circuit detects a voltage between a base and an emitter of the NPN transistor thereby to detect the value of the current applied to the primary coil by the switching circuit. The switching circuit may be constituted of a plurality of transistors in the Darlington connection. The transistor of the first stage among the transistors in the Darlington connection in this case which is directly driven/switched by the driving circuit may be an NPN transistor.

Furthermore, the switching circuit may be constituted of a plurality of NPN transistors in the Darlington connection. In this case, the current limiting circuit detects a voltage between a base of the NPN transistor of the first stage directly driven/switched by the driving circuit and an emitter of the NPN transistor of the last stage in the switching circuit thereby to detect the value of the current applied to the primary coil by the switching circuit. The signal from the ECU and the switching driving signal are desirably binary signals.

BRIEF DESCRIPTION OF THE DRAWINGS

These and other objects and features of the present invention will become clear from the following description taken in conjunction with the preferred embodiment thereof with reference to the accompanying drawings throughout which like parts are designated by like reference numerals, and in which.

DETAILED DESCRIPTION OF THE PREFERRED EMBODIMENT

The present invention will be described in detail in conjunction with preferred embodiments shown in the accompanying drawings.

Embodiment 1

Figure 1:
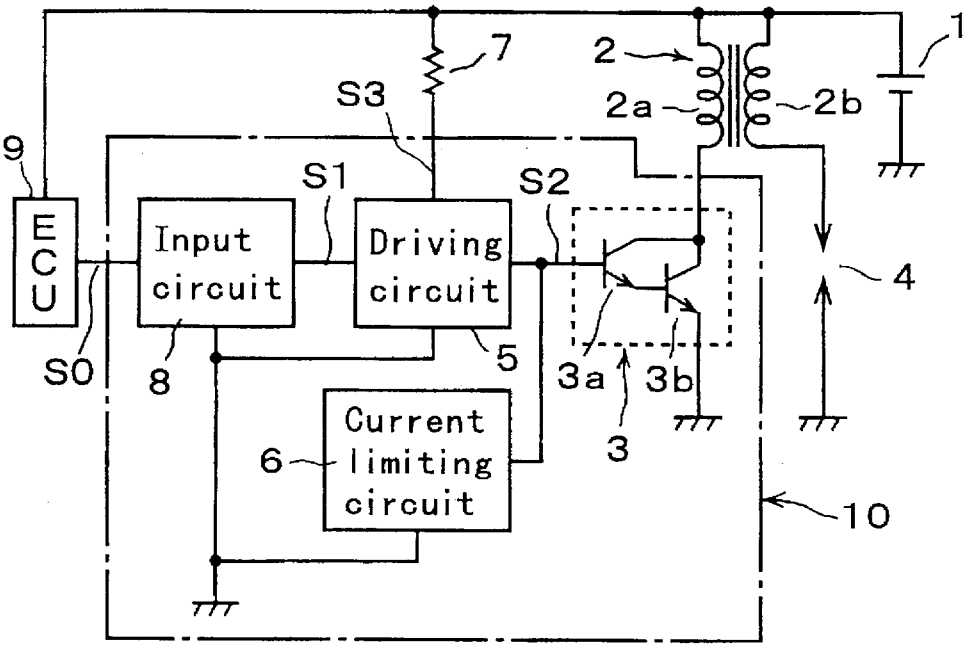
FIG. 1 is a block diagram schematically showing an example of an ignition coil control circuit according to an embodiment 1 of the present invention.

FIG. 1 is a block diagram schematically showing an example of an ignition coil control circuit according to an embodiment 1 of the present invention. In FIG. 1, a battery 1 is connected to a primary coil 2*a* and a secondary coil 2*b* of an ignition coil 2. The other end of the primary coil 2*a* is connected to a collector of a Darlington power transistor 3 formed of two NPN power transistors 3*a*, 3*b* connected in Darlington connection. An emitter of the Darlington power transistor 3 is grounded, and the other end of the secondary coil 2*b* of the ignition coil 2 is grounded via an ignition plug 4.

The Darlington power transistor 3 has its base connected both to a driving circuit 5 for driving the Darlington power transistor 3 and to a current limiting circuit 6. The base of the Darlington power transistor 3 denotes a base of the NPN power transistor 3*a* of the first stage, and the emitter of the Darlington power transistor 3 denotes an emitter of the NPN power transistor 3*b* of the last stage. The collector of the Darlington power transistor 3 denotes a connecting part of collectors of the NPN power transistors 3*a* and 3*b*.

The current limiting circuit 6 restricts a base current of the Darlington power transistor 3 so as not to flow a current of a predetermined regulated value or more to the primary coil 2*a* of the ignition coil 2 while the Darlington power transistor 3 is turned on. The driving circuit 5 is not only connected to the battery 1 via a source resistor 7, but also connected to an input circuit 8 which is connected to an ECU 9. The input circuit 8 outputs to the driving circuit 5 a signal to turn on/off the Darlington power transistor 3 in accordance with a signal from the ECU 9.

Each of the driving circuit 5, current limiting circuit 6 and input circuit 8 has an earth terminal which is grounded. The ECU 9 is connected to the input circuit 8 by a signal line S0, the input circuit 8 is connected to the driving circuit 5 by a signal line S1, and the driving circuit 5 is connected to the source resistor 7 by a signal line S3.

In the constitution as above, the input circuit 8 operates upon receipt of the signal from the ECU 9 as the power source, and the current limiting circuit 6 operates with using the voltage between the base and emitter of the Darlington power transistor 3 as the power source. The ECU 9 is generally so adapted as to stabilize the level of the output signal without being influenced by a voltage change of the battery 1 up to a predetermined range, and therefore the input circuit 8 is enabled to operate stably without being influenced by the voltage change in the battery 1.

For instance, when a signal in the H level is output to the input circuit 8 from the ECU 9, the input circuit 8 makes the driving circuit 5 supply a current to the base of the Darlington power transistor 3, thereby turning on the Darlington power transistor 3 and flowing the current to the primary coil 2*a* of the ignition coil 2. At the same time, when the Darlington power transistor 3 receives the current at its base from the driving circuit 5, a voltage is generated between the base and emitter of the Darlington power transistor 3, to be fed to the current limiting circuit 6. That is, the current limiting circuit 6 uses the voltage between the base and emitter of the Darlington power transistor 3 as the power source therefor.

The voltage between the base and emitter of the Darlington power transistor 3 is raised as the current flowing to the collector of the Darlington power transistor 3 is increased. Therefore, the current limiting circuit 6, while using the voltage between the base and emitter of the Darlington power transistor 3 as the power source therefor, shuts the current being fed to the base of the Darlington power transistor 3 from the driving circuit 5 if the voltage between the base and emitter of the Darlington power transistor 3 exceeds a predetermined value, whereby the Darlington power transistor 3 is turned off. Since the power supply to the current limiting circuit 6 is shut as well when the current supply to the base of the Darlington power transistor 3 is stopped, the current is again started to be supplied to the base of the Darlington power transistor 3. The current to the collector of the Darlington power transistor 3 is controlled by repeating the above procedures.

Meanwhile, when the level of the signal output from the ECU 9 to the input circuit 8 is turned to L, the supply of power to the input circuit 8 is shut and the driving circuit 5 is made to stop the power supply to the base of the Darlington power transistor 3. The Darlington power transistor 3 is consequently turned off. The power supply to the current limiting circuit 6 is stopped by this interruption of the power supply to the base of the Darlington power transistor 3. The Darlington power transistor 3, driving circuit 5, current limiting circuit 6 and input circuit 8 constitute an ignition coil control circuit 10 formed of a hybrid integrated circuit. Moreover, the Darlington power transistor 3 works as a switching part, the driving circuit 5 functions as a driving part, the input circuit 8 as a control signal output part and the current limiting circuit 6 as a current control part.

The above driving circuit 5, current limiting circuit 6 and input circuit 8 will now be more fully described with reference to concrete examples thereof.

Figure 2:
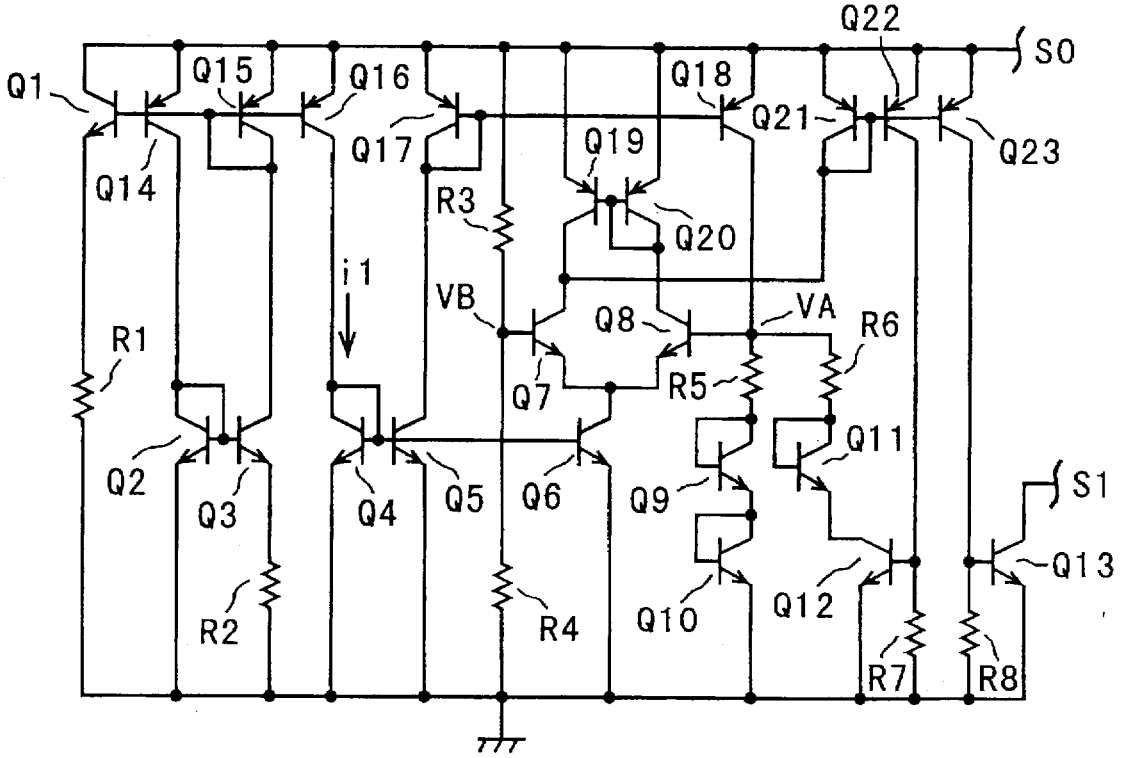
FIG. 2 is a circuit diagram of an example of an input circuit 8 in FIG. 1.

FIG. 2 is a circuit diagram of an example of the input circuit 8. 13 NPN transistors Q1 through Q13, 10 PNP transistors Q14 through Q23 and 8 resistors R1–R8 compose the input circuit 8.

The transistors Q1–Q3, Q14–Q16 and resistors R1, R2 constitute a constant current source. Transistors Q6–Q8, Q19 and Q20 form a differential amplifier circuit. Among the transistors, transistors Q1 and Q14–Q16 form a current Miller circuit, while transistors Q2 and Q3 form a current Miller circuit. Moreover, transistors Q4–Q6, transistors Q17 and Q18, transistors Q19 and Q20, and transistors Q21–Q23 form current Miller circuits, respectively.

Bases of the transistors Q1 and Q14–Q16 are connected sequentially one another. A collector of the transistor Q1 and emitters of the transistors Q14–Q16 are each connected to the above-mentioned signal line S0. A collector and a base of the transistor Q15 are connected each other. The collector of the transistor Q15 is connected to a collector of the transistor Q3. A collector of the transistor Q14 is connected to a collector of the transistor Q2, and the collector of the transistor Q2 is connected to its base which is connected to a base of the transistor Q3. An emitter of the transistor Q2 is grounded, and an emitter of the transistor Q3 is grounded via the resistor R2.

A collector of the transistor Q16 is connected to a collector of the transistor Q4. The collector and a base of the transistor Q4 are connected with each other. Bases of the transistors Q4–Q6 are connected with each other and emitters of the transistors Q4–Q6 are grounded. A collector of the transistor Q5 is connected to a collector of the transistor Q17. A base of the transistor Q17 is connected to the collector thereof and a base of the transistor Q18. Emitters of the transistors Q17 and Q18 are connected to the signal line S0.

Emitters of the transistors Q7 and Q8 are connected with each other to the collector of the transistor Q6. A base of the transistor Q7 is grounded via the resistor R4, and moreover connected to the above signal line S0 via the resistor R3. A collector of the transistor Q7 is connected to a collector of the transistor Q19, while a collector of the transistor Q8 is connected to a collector of the transistor Q20. The collector and base of the transistor Q20 are connected each other. Bases of the transistors Q19 and Q20 are connected with each other and the respective emitters are connected to the signal line S0.

Transistors Q9–Q11 have respective collectors and bases connected each other. The resistor R5 is connected to the collector of the transistor Q9 an emitter of which is connected to the collector of the transistor Q10. An emitter of the transistor Q10 is grounded. Further, the resistor R6 and the collector of the transistor Q11 are connected each other, and an emitter of the transistor Q11 and a collector of the transistor Q12 are connected each other. An emitter of the transistor Q12 is earthed. The other ends of the resistors R5 and R6 are connected with each other to a base of the transistor Q8, and at the same time connected to a collector of the transistor Q18. The resistor R5 and transistors Q9 and Q10 generate one reference voltage for the differential amplifier circuit. On the other hand, the resistor R6 and transistors Q11 and Q12 generate another reference voltage for the differential amplifier circuit.

Emitters of the transistors Q21–Q23 are each connected to the signal line S0 and bases of these transistors are mutually connected. A collector and the base of the transistor Q21 are connected, and the collector of the transistor Q21 is connected to the collector of the transistor Q7. A collector of the transistor Q22 is connected to a base of the transistor Q12, while a collector of the transistor Q23 is connected to a base of the transistor Q13. Moreover, the resistor R7 is connected between the base and emitter of the transistor Q12, with the resistor R8 interposed between the base and emitter of the transistor Q13. The resistor R7 is a leak cut resistor to prevent the erroneous operation of the transistor Q12 caused by a leak current. The resistor R8 is similarly a leak cut resistor to prevent the erroneous operation of the transistor Q13 due to a leak current. A collector of the transistor Q13 is connected to the signal line S1 to the driving circuit 5.

In the thus-constituted structure, when a voltage is impressed from the ECU 9 to the signal line S0, the constant current source supplies a constant current i1 to bases of the transistors Q4–Q6 thereby turning on the transistors Q4–Q6. When the transistor Q5 is turned on, the constant current i1 is applied from the collector of the transistor Q5 to the transistor Q17 and also to the transistor Q18 because the transistors Q17 and Q18 form the current mirror circuit as mentioned before. The constant current i1 flows to the resistor R5 and transistors Q9 and Q10. Supposing that a voltage between the base and emitter of the transistor Q9 is VQ9, that of the transistor Q10 is VQ10, and a base voltage VA of the transistor Q8 at this time is VA1, VA1 is the reference voltage for the differential amplifier circuit and expressed by an equation (1) below:

$$VA1=i1\times R5+VQ9+VQ10 \quad (1)$$

In the above equation (1), R5 indicates a resistance value of the resistor R5.

The voltage applied to the signal line S0 from the ECU 9 is divided by the resistors R3 and R4 and then impressed to the base of the transistor Q7 which is VB. VB is increased in accordance with an increase of the voltage impressed to the signal line S0. If VB exceeds VA1, the transistor Q7 is turned on. In consequence of this turning-on of the transistor Q7 and because the transistor Q6 is in the ON state, the transistor Q21 is brought into the ON state and accordingly the transistors Q22 and Q23 constituting the current mirror circuit with the transistor Q21 are turned on. As a result, a collector current of the transistor Q22 is applied to the base of the transistor Q12, thereby turning on the transistor Q12. In the same manner as above, when the transistor Q23 is turned on, a collector current of the transistor Q23 is fed to the base of the transistor Q13, whereby the transistor Q13 is turned on.

When the transistor Q12 is turned on, the above constant current i1 flows to the resistor R6 and transistors Q11 and Q12. Supposing that a voltage between the base and emitter of the transistor Q11 is VQ11, that of the transistor Q12 is VQ12, and the base voltage of the transistor Q8 is VA2, VA2 is represented by an equation (2) as follows:

$$VA2=i1\times R6+VQ11+VQ12 \quad (2)$$

wherein R6 is a resistance value of the resistor R6.

When the voltage impressed to the signal line S0 is decreased and VB becomes smaller than VA2, the transistor Q7 is turned off, whereby the transistors Q12 and Q13 are turned off.

Figure 3:
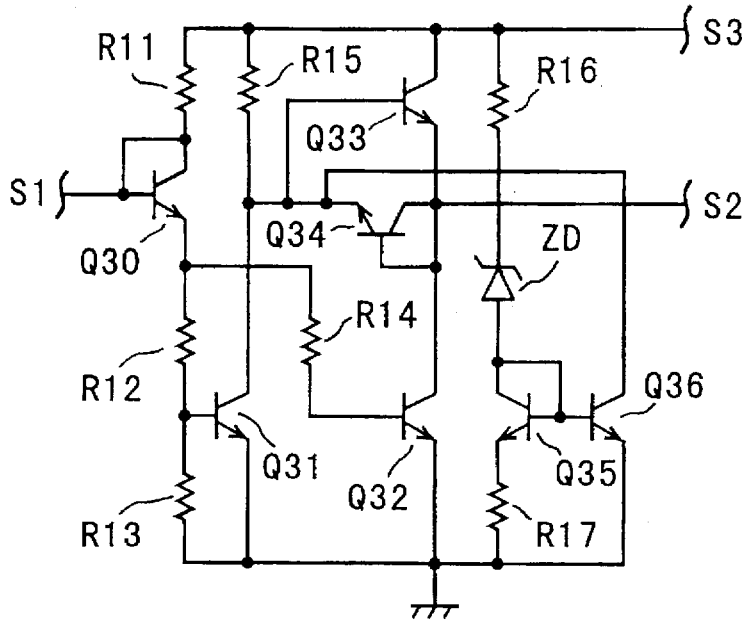
FIG. 3 is a circuit diagram of an example of a driving circuit 5 in FIG. 1.

FIG. 3 is a circuit diagram of an example of the driving circuit 5. In FIG. 3, the driving circuit 5 consists of 7 NPN transistors Q30–Q36, 7 resistors R11–R17 and a Zener diode (referred to as a Z diode hereinafter) ZD. The transistors Q30–Q34 and resistors R11–R15 constitute a driving circuit part for driving/controlling the Darlington power transistor 3. The transistors Q35 and Q36, resistors R16 and R17 and Z diode ZD constitute a shutting circuit part in preparation for a case where a high voltage is impressed to the signal line S3.

A base connected to the signal line S1 and a collector of the transistor Q30 are connected each other. The collector of the transistor Q30 is connected to the signal line S3 via the resistor R11. An emitter of the transistor Q30 is connected to a base of the transistor Q31 via the resistor R12 and further connected to a base of the transistor Q32 via the resistor R14. The resistor R13 is disposed between the base and an emitter of the transistor Q31, and a collector of the transistor Q31 is connected to the signal line S3 via the resistor R15. The emitter of the transistor Q31 is grounded. Moreover, to the collector of the transistor Q31 are connected a base of the transistor Q33 and an emitter of the transistor Q34.

The base of the transistor Q33 is connected to the signal line S3 and, an emitter of the same transistor Q33 is connected to collectors of the transistor Q34 and Q32. An emitter of the transistor Q32 is grounded. The collector and base of the transistor Q34 are connected each other. A connecting part where the collector of the transistor Q32, emitter of the transistor Q33 and a connecting part between the collector and base of the transistor Q34 are all connected is connected to the signal line S2 to the base of the Darlington power transistor 3. The driving circuit part is constituted as above.

The transistors Q35 and Q36 form a current Miller circuit. A collector and a base of the transistor Q35 are connected each other. Bases of the transistors Q35 and Q36 are connected each other. The collector of the transistor Q35 is connected to an anode of the Z diode ZD, and a cathode of the Z diode ZD is connected to the signal line S3 via the resistor R16. An emitter of the transistor Q35 is grounded via the resistor R17 and an emitter of the transistor Q36 is grounded. A collector of the transistor Q36 is connected to the emitter of the transistor Q34. The shutting circuit part is thus constituted.

In the above-described constitution, when the transistor Q13 of the input circuit 8 is turned on, the current supplied from the signal line S3 via the source resistor 7 becomes a collector current of the transistor Q13 via a resistor R11, not flowing to bases of the transistors Q31 and Q32. As a result of this, the current is sent from the signal line S3 to the base of the transistor Q33 via the resistor R15, whereby the transistor Q33 is turned on. A collector current of the transistor Q33 is thus supplied to the base of the Darlington power transistor 3 via the signal line S2. Thereby, the Darlington power transistor 3 is turned on. The resistor R13 is a leak cut resistor to prevent the erroneous operation of the transistor Q31 by a leak current. The resistor R13 may be inserted between the base and emitter of the transistor Q32, not between the base and emitter of the transistor Q31.

On the other hand, when the transistor Q13 of the input circuit 8 is turned off, the transistor Q30 is turned on, so that a collector current of the transistor Q30 is sent to the bases of the transistors Q31 and Q32 via resistors R12 and R14, respectively. The transistors Q31 and Q32 are consequently turned on. Moreover, because of the turning-on of the transistor Q31, the current is refrained from flowing to the base of the transistor Q33, thereby bringing the transistor Q33 into the OFF state. In consequence, since the base of the Darlington power transistor 3 is grounded by the transistor Q32 via the signal line S2, the Darlington power transistor 3 is turned off. The driving circuit 5 controls driving of the Darlington power transistor 3 in the above-depicted manner.

The Z diode ZD of a Zener voltage employed in the embodiment normally hinders the current from running to bases of the transistors Q35 and Q36 to turn on the transistors Q35 and Q36. However, once a high voltage is impressed to the signal line S3, a Zener current is applied to the Z diode ZD, running as base currents for the transistors Q35 and Q36 thereby to turn on the transistors Q35 and Q36. The base of the Darlington power transistor 3 is accordingly grounded by the transistor Q36, when the Darlington power transistor 3 is turned off. The shutting circuit part prevents the high voltage impressed to the signal line S3 from being applied to the Darlington power transistor 3, in other words, prevents the Darlington power transistor 3 from being broken.

Figure 4:
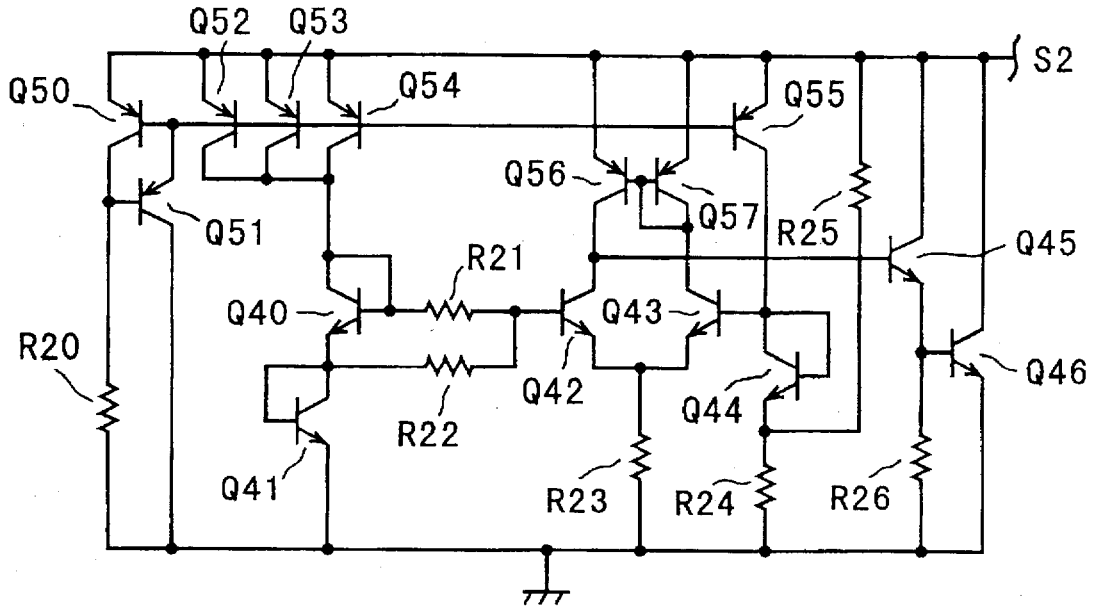
FIG. 4 is a circuit diagram of an example of a current limiting circuit 6 in FIG. 1.

FIG. 4 is a circuit diagram of an example of the current limiting circuit 6. The current limiting circuit 6 in FIG. 4 consists of 7 NPN transistors Q40–Q46, 8 PNP transistors Q50–Q57, and 7 resistors R20–R27. The transistors Q50–Q55 and resistor R20 constitute a constant current source, while the transistors Q42, Q43, Q56 and Q57 and resistor R23 form a differential amplifier circuit. Among the transistors, transistors Q50–Q55 constitute a current mirror circuit and, transistors Q56 and Q57 likewise constitute a current mirror circuit.

Bases of the transistors Q50 and Q52–Q55 are mutually connected and emitters of these transistors are connected to the signal line S2. Further, the base of the transistor Q50 is connected to an emitter of the transistor Q51 and a collector of the transistor Q50 is connected to a base of the transistor Q51. A connecting part between the collector of the transistor Q50 and the base of the transistor Q51 is grounded via the resistor R20. A collector of the transistor Q51 is earthed. Collectors of the transistors Q52–Q54 are connected each other to a collector of the transistor Q40.

The collector and base of the transistor Q40 are connected with each other. A series circuit of resistors R21 and R22 is connected between the base and emitter of the transistor Q40. A connecting part of the resistors R21 and R22 is connected to a base of the transistor Q42. At the same time, the emitter of the transistor Q40 is connected to a collector of the transistor Q41. The collector of the transistor Q41 is connected to a base thereof. An emitter of the transistor Q41 is grounded. Emitters of the transistors Q56 and Q57 are each connected to the signal line S2 and bases of these transistors Q56 and Q57 are connected each other. A collector of the transistor Q56 is connected to a collector of the transistor Q42, the base and collector of the transistor Q57 are connected each other, and the collector of the transistor Q57 is connected to a collector of the transistor Q43.

Emitters of the transistors Q42 and Q43 are connected each other to be grounded via a resistor R23. A collector of the transistor Q55 is connected to a collector of the transistor Q44, with a connecting part therebetween being connected to a base of the transistor Q43. An emitter of the transistor Q44 is grounded via the resistor R24 and the collector and a base of the transistor Q44 are connected. A connecting part between the emitter of the transistor Q44 and the resistor R24 is connected to the signal line S2 via the resistor R25. A collector of each transistor Q45, Q46 is connected to the signal line S2. An emitter of the transistor Q45 is connected to a base of the transistor Q46. The transistors Q45 and Q46 are in the Darlington connection. A base of the transistor Q45 is connected to a connecting part between collectors of the transistors Q56 and Q42. The resistor R26 is connected between the base and earthed emitter of the transistor Q46.

In the above constitution, when the collector current of the Darlington power transistor 3 is increased, the voltage between the base and emitter of the Darlington power transistor 3 is similarly increased. As a result, the signal line S2 has a higher voltage. If the voltage exceeds a predetermined value, the transistor Q42 constituting the differential amplifier circuit is turned off to turn off the transistor Q43, consequently turning on the transistor Q45 and the transistor Q46. When the transistor Q46 is turned on, the current fed to the base of the Darlington power transistor 3 from the driving circuit 5 flows as the collector current of the transistor Q46, and therefore the base current is not fed to the Darlington power transistor 3. Thereby, the Darlington power transistor 3 is turned off.

In the meantime, when the voltage of the signal line S2 is decreased as a result of the turning-off of the Darlington power transistor 3 subsequent to the turning-on of the transistor Q46, the transistor Q46 is returned to the OFF state and the current supplied from the driving circuit 5 starts to flow to the base of the Darlington power transistor 3. In the manner as above, the current limiting circuit 6 controls the collector current of the Darlington power transistor 3 not to supply the current of not smaller than a regulated value to the primary coil 2*a* of the ignition coil 2.

Figure 5:
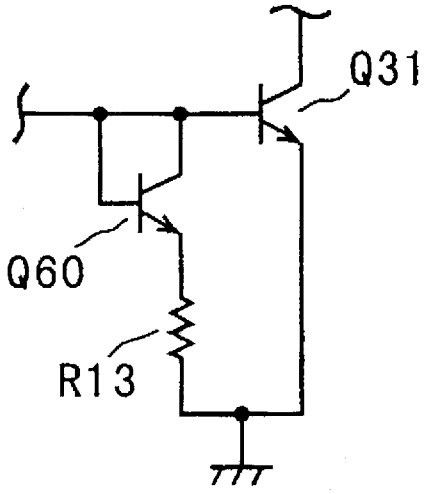
FIG. 5 is a diagram of an example of a preventing circuit for preventing the erroneous operation of a transistor.

In the ignition coil control circuit in the embodiment 1, the leak cut resistor is connected between the emitter and base of each of transistors Q12, Q13 and Q31 so as to prevent the erroneous operation of the transistors Q12, Q13 and Q31 due to a leak current. Meanwhile, if the leak current is required to be cut more highly accurately, such a circuit as shown in FIG. 5 is preferred. FIG. 5 exemplifies the transistor Q31.

In FIG. 5, in order to prevent the transistor Q31 from erroneously operating by the leak current, a series circuit consisting of a transistor Q60 and the resistor R13 is connected between the base and emitter of the transistor Q31. Specifically, a collector of the transistor Q60 is connected to a base of the transistor Q31, and an emitter of the transistor Q60 is connected to the emitter of the transistor Q31 via the resistor R13. The collector and a base of the transistor Q60 are connected with each other.

Figure 6:
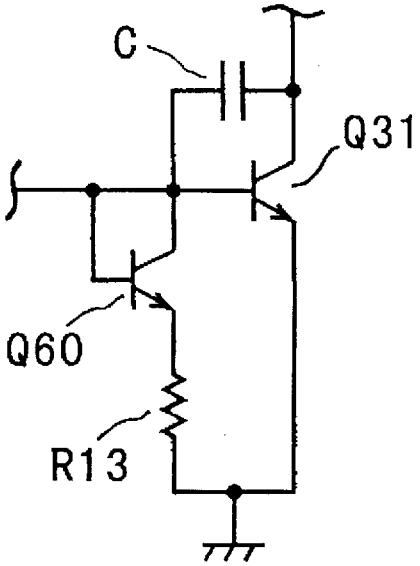
FIG. 6 is a circuit diagram of an example whereby a Darlington power transistor 3 in FIG. 1 is turned on with a delay.
Figure 7:
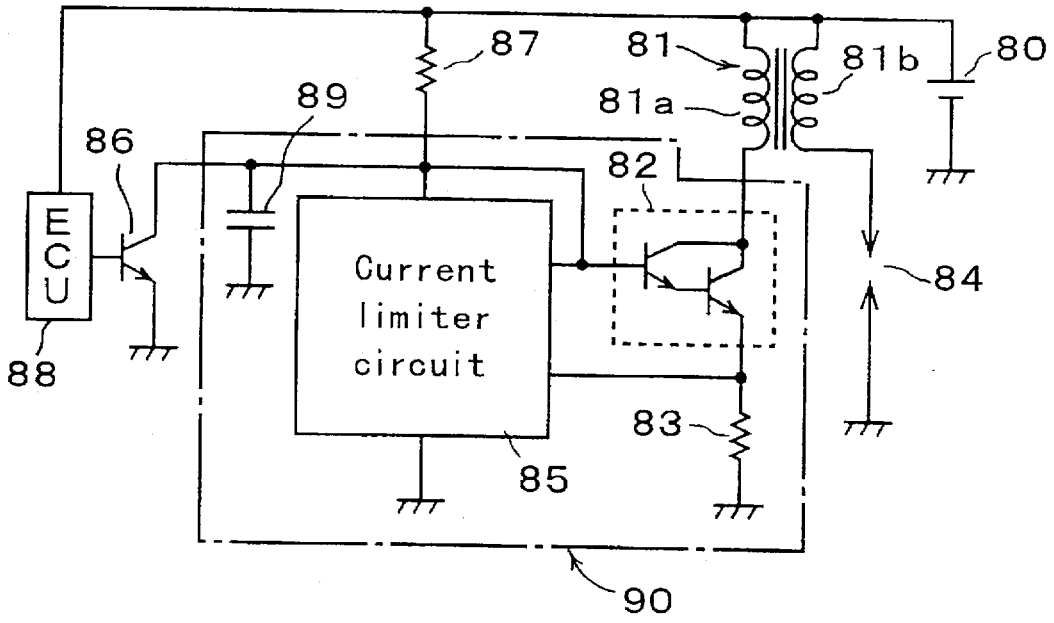
Fig. 7 CONVENTIONAL ART
FIG. 7 is a block diagram schematically showing a conventional ignition coil control circuit.

Further, for preventing the erroneous operation of the Darlington power transistor 3, particularly, when the Darlington power transistor 3 is switched from the OFF state to the ON state, a delay capacitor should be added to the transistor Q31 in the structure shown in FIG. 5. FIG. 6 is an example when the delay capacitor is added to the circuit of FIG. 5, in which the same parts are designated by the same reference numerals.

A difference from FIG. 5 is a delay capacitor C connected between the collector and base of the transistor Q31. Owing to the delay capacitor C, the time when the Darlington power transistor 3 is turned on is delayed, making it possible to prevent the erroneous operation of the Darlington power transistor 3 when it is turned on from the OFF state.

As described hereinabove, according to the ignition coil control circuit in the embodiment 1 of the present invention, the driving circuit 5, current limiting circuit 6 and input circuit 8 can be constituted of a single hybrid integrated circuit. Moreover, the input circuit 8 and current limiting circuit 6 use the signal from the ECU 9 and the voltage between the base and emitter of the Darlington power transistor 3 as the respective operation power sources, and accordingly stably operate without being influenced by a change of the voltage of the battery 1. A capacitor for the stabilization of the power source which has been used conventionally is eliminated. Since the current limiting circuit 6 detects the change of the voltage between the base and emitter of the Darlington power transistor 3 thereby detecting the current flowing in the primary coil 2*a* of the ignition coil 2, it is not necessary to use a current detection resistor which is a highly accurate, but high-cost resistor. The ignition coil control circuit of the present invention accordingly stably operates without being influenced by the voltage change in the battery 1 with costs reduced.

The above-described embodiment 1 uses the Darlington power transistor 3 constituted of two NPN transistors in the Darlington connection. Instead of the Darlington power transistor 3, one NPN transistor may be employed to control the current flowing to the primary coil 2*a* of the ignition coil 2. The NPN transistor in this case should be of a large current amplification rate. Alternatively, the Darlington power transistor 3 may be formed of an NPN transistor and a PNP transistor in the Darlington connection and, the NPN transistor in this case should be set in the first stage. A value of the current running in the primary coil 2*a* of the ignition coil 2 can be detected by detecting the voltage between the base and emitter of the NPN transistor of the first stage. Three or more transistors may be used to constitute the Darlington power transistor 3. Furthermore, although the current limiting circuit 6 may be constructed with the use of the conventional current detection resistor, costs cannot be decreased by the reduction of the current detection resistor.

As is made clear from the foregoing description, in the ignition coil control circuit according to the present invention, the control signal output part uses as its power source the signal, e.g., binary signal, from the ECU which is so adapted as to keep the level of the output signal stable without being influenced by the change of the voltage of the battery within a predetermined range, and also the current limiting part uses as its power source the switching driving signal, for example, binary signal output from the driving part to switch the switching part. Therefore, the ignition coil control circuit can operate stably without being influenced by the voltage change in the battery which is the power source for the ignition coil control circuit. Moreover, since it is not necessary to use a capacitor for the stabilization of the power source although employed in the prior art, costs can be reduced.

The switching part is constituted of an NPN transistor. A value of the current sent to the primary coil of the ignition coil, that is, a value of the collector current of the NPN transistor can be detected by detecting the voltage between the base and emitter of the NPN transistor. The switching part may be formed of a plurality of transistors in the Darlington connection, wherein the transistor of the first stage directly driven by the driving part is an NPN transistor. For example, when a plurality of NPN transistors are connected in the Darlington connection thereby to constitute the switching part, the current running in the primary coil of the ignition coil, i.e., collector current of the Darlington-connected transistor can be detected by detecting the voltage between the base of the NPN transistor of the first stage and the emitter of the NPN transistor of the last stage. Hence, a conventionally-used current detection resistor which is accurate, but costs high is not necessitated, whereby costs of the ignition coil control circuit are reduced further.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An ignition coil control circuit which controls, in accordance with a signal from an ECU, a current flowing to a primary coil of an ignition coil for impressing a high voltage to an ignition plug, said ignition coil control circuit comprising:

a switching circuit for switching the primary coil of said ignition coil;

a driving circuit for driving said switching circuit;

a control signal output circuit for generating and outputting a driving control signal to said driving circuit in accordance with the signal from said ECU; and a current limiting circuit for detecting a value of a current applied to said primary coil by said switching circuit and controlling said switching circuit so as to make said current not larger than a predetermined value, wherein said control signal output circuit uses the signal from said ECU as its power source, and said current limiting circuit uses a switching driving signal output from said driving circuit as its power source.

2. The ignition coil control circuit according to claim 1, wherein said switching circuit is formed of an NPN transistor.

3. The ignition coil control circuit according to claim 2, wherein said current limiting circuit detects a voltage between a base and an emitter of said NPN transistor thereby to detect a value of the current applied to said primary coil by said switching circuit.

4. The ignition coil control circuit according to claim 1, wherein said switching part is constituted of a plurality of transistors in the Darlington connection, and a transistor of the first stage among said plurality of transistors in the Darlington connection which is directly driven by said driving circuit is an NPN transistor.

5. The ignition coil control circuit according to claim 4, wherein said switching circuit is constituted of a plurality of NPN transistors in the Darlington connection.

6. The ignition coil control circuit according to claim 5, wherein said current limiting circuit detects a voltage between a base of the NPN transistor of the first stage directly driven by said driving circuit and an emitter of the NPN transistor of the last stage in said switching circuit thereby to detect the value of the current applied to said primary coil by said switching circuit.

7. The ignition coil control circuit according to claim 1, wherein the signal from said ECU and said switching driving signal are binary signals.

* * * * *